United States Patent [19]

Ito et al.

[11] 4,117,650

[45] Oct. 3, 1978

[54] TAPE WINDING ARRANGEMENT FOR PAPER BUNDLE BINDING APPARATUS

[75] Inventors: Yukio Ito, Fujisawa; Susumu Morishima, Kamakura, both of Japan

[73] Assignees: Hitachi Denshi Engineering Kabushiki Kaisha; Musashi Kabushiki Kaisha, Tokyo, both of Japan

[21] Appl. No.: 791,150

[22] Filed: Apr. 26, 1977

[30] Foreign Application Priority Data

Apr. 27, 1976 [JP] Japan ..... 51-47210

[51] Int. Cl.[2] ..... B65B 13/04; B65B 27/08

[52] U.S. Cl. ..... 53/587; 53/589; 100/27

[58] Field of Search ..... 53/198 R, 199, 124 C, 53/210, 218; 100/27, 28

[56] References Cited

U.S. PATENT DOCUMENTS

| | | | |
|---|---|---|---|
| 1,235,312 | 7/1917 | Hadert | 53/210 |
| 1,671,376 | 5/1928 | Parker | 100/27 |
| 2,198,440 | 4/1940 | Marchand | 100/27 |
| 2,367,168 | 1/1945 | Cheesman | 100/27 X |
| 3,955,340 | 5/1976 | Tomita et al. | 53/199 |

FOREIGN PATENT DOCUMENTS

| | | | |
|---|---|---|---|
| 566,309 | 12/1944 | United Kingdom | 100/27 |

*Primary Examiner*—John Sipos

*Attorney, Agent, or Firm*—Wenderoth, Lind & Ponack

[57] ABSTRACT

Disclosed in a tape winding mechanism for an apparatus for binding a bundle of stacked paper sheets such as paper money with a binding tape or strip. The apparatus comprises a rotatable ring-like flyer body provided with a first stationary guide roller and a second movable roller which is mounted on a flyer ring in such a manner that it can be brought into contact with the first guide roller, to thereby hold and guide a nipped tape end portion under the resilient force of a spring. The bundle of papers to be bound is disposed in an inner space of the flyer ring body. The binding tape is fed from a supply reel and the leading end portion is inserted into the paper stack which is then held in a compressed state. When the flyer body is rotated around the paper by a suitable drive means, the tape as held and guided by the first and second rollers is wound around the paper bundle in a desired number of turns. Thereafter the tape is cut and the cut end portion of the tape is bonded to the wound tape portion. Tape winding operations are controlled through lever systems and a control cam.

4 Claims, 6 Drawing Figures

TAPE WINDING ARRANGEMENT FOR PAPER BUNDLE BINDING APPARATUS

BACKGROUND OF THE INVENTION

The present invention relates in general to a binder apparatus for binding a bundle of stacked paper sheets such as paper money and in particular to an apparatus for winding a binding tape around the bundle of stacked paper sheets in such binder apparatus.

In some applications, it is known that a bundle of many sheets of paper such as paper money is required to be bound by winding a binder tape therearound. In such case, a forward end of the binder tape as fed from a suitable supply reel is first inserted into the stacked papers. When the tape has been wound around the paper stack in a desired number of turns, the tape is cut and the cut end portion is bonded to the other tape portion wound around the paper stack in a superposed position. An important problem in such binding operation resides of course in whether the bundle of stacked paper sheets of a given thickness can be securely bound without the possibility of the bound paper sheets thereafter becoming loosened. In order to accomplish a positive binding operation, it is required that the binder tape be maintained in a tensioned state during the winding operation.

Hithertofore, the winding operation of the binder tape has in most cases been performed manually by an operator. Accordingly, difficulties have been encountered in maintaining the binder tape in a desired tensioned state which is a difficult condition to control. Thus, it has heretofore been impossible to carry out the paper bundle binding operation with a high efficiency.

SUMMARY OF THE INVENTION

An object of the invention is to provide a novel and improved tape winding mechanism for a binder apparatus for binding a bundle of paper sheets such as paper money or fills with a binding tape, which mechanism allows a completely automatic tape winding operation with an enhanced efficiency and an improved yield.

Another object of the invention is to provide a winding apparatus of the above type which can be implemented inexpensively in a rigid and simplified structure.

With the above objects in mind, there is proprosed according to a feature of the invention an apparatus for winding a binding tape around a stack of paper sheets for use in an apparatus for binding a stack of paper sheets with the binding tape which comprises an annular flyer body having an inner hollow space in which a stack of paper sheets to be bound is disposed, means for rotatably supporting the annular flyer body, means for revolving the annular flyer body about a center point thereof, a first guide roller mounted on the flyer body at a predetermined position, a second guide roller adapted to be detachably engaged with the first guide roller for holding and guiding the binding tape in tension in cooperation with the first guide roller, a spring means for urging the second guide roller toward a position to engage with the first guide roller, and means for displacing the second guide roller away from the first guide roller.

BRIEF DESCRIPTION OF THE DRAWINGS

The invention will become more readily apparent from the following description of preferred embodiments thereof shown, by way of example only, in the accompanying drawings, in which.

DETAILED DESCRIPTION OF PREFERRED EMBODIMENTS

The invention will now be described with reference to FIG. 1 which shows an exemplary embodiment of the paper bundle binding apparatus constructed in accordance with the teachings of the inventors of the present invention.

Figure 1:
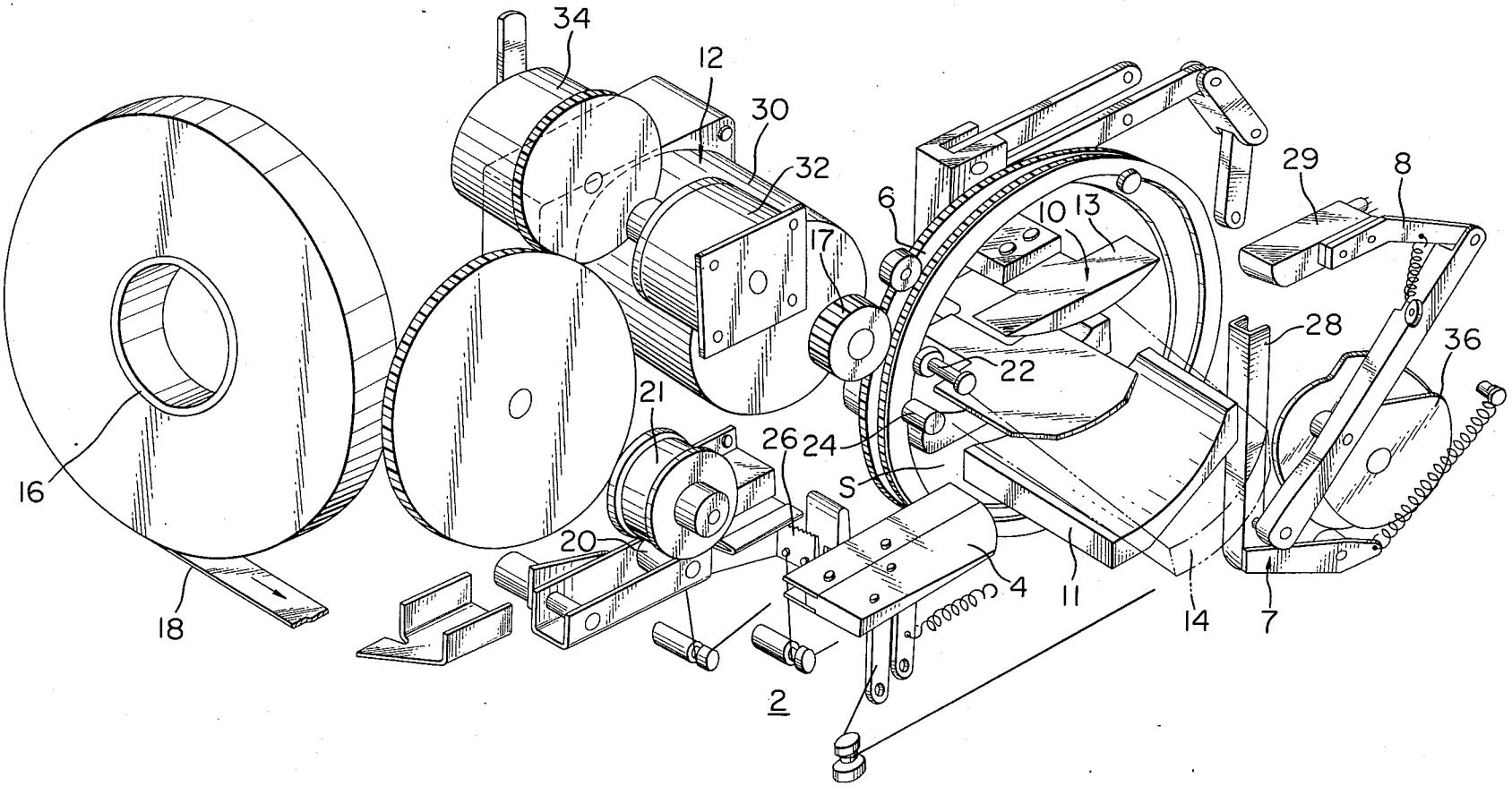
FIG. 1 is a partially exploded perspective view showing a general arrangement of a paper sheet bundle binder apparatus which incorporates therein a tape winding apparatus constructed in accordance with the teachings of the invention.

Referring to FIG. 1 which shows schematically a general arrangement of a paper bundle binding apparatus for binding a stack of paper sheets, such as paper money, the binding apparatus generally denoted by reference numeral 2 comprises a divider unit 4 for dividing a loaded stack 14 of paper sheets such as paper money for producing therein a gap, a flyer assembly 6 for winding a binder type or band around a paper sheet bundle, a press unit 7 for pressing together the end portions of the binder tape, a sealing unit or assembly 8 for bonding the pressed end portions of the binder tape to the other tape portion wound around the stack of paper sheets, a clamping unit 10 for pressing the stacked paper, a driving unit 12, a tape feeding or dispensing means 20 and a tape cutting unit 26.

When a bundle 14 of stacked paper sheets such as paper money is to be bound with the aid of the binder apparatus 2 shown in FIG. 1, the divider unit 4 is first moved from a position shown in solid lines in FIG. 1 to a position in the path (shown in broken lines) along which the paper stack or bundle is fed, as a result of which a gap is produced in the paper stack 14, as the stack is fed to the divider unit 4. A tape 18, which may be a heat sensitive binding tape stored as wound on the supply reel 16 in a form of a roll, is then drawn or dispensed. The leading end portion of the binder tape or band 18 is fed along a predetermined path by means of a pinch roller 20 and a feeding roller 21 and inserted into the gap or space produced in the stack of paper sheets. When the binder band 18 has thus been properly placed, the bundle of the paper 14 is subjected to a clamping force through the clamping means 10. Subsequently, the binder tape 18 is nipped between a pair of pins 22 and 24 of the banding winding unit 6 which are rotatable relative to each other. When the band winding unit 6 is revolved with the binder tape or band 18 being in the nipped state, the latter is wound around the bundle of paper 14 (refer to FIG. 6). When a predetermined length of the binding tape has been wound around the paper bundle, the cutter means 26 which may be of any suitable conventional type is actuated upwardly to cut the tape 18, while the tape is prevented from becoming loosened by means of a lever 28. Subsequently, the end portion of the tape 18 as cut is bonded to the wound tape portion under the action of a bonding pad 29. The paper stack 14 thus having been completely bound is then discharged from the apparatus. The above operations of the binder apparatus are effected by the driving unit or mechanism 12 comprising a motor 30, braking means 32 and a clutch 34. Further, the timing required in the above outlined operations of the binder apparatus is effected with the aid of cam means 36 which is adapted to be driven by the driving means 12 and which are only partially shown in the drawings. Although the paper bundle or stack 14 is shown as fed into the binder apparatus in the substantially horizontal position, it will be appreciated that the paper stack 14 may be inserted in a slightly or considerably inclined state so that the loading of the paper stack 14 may be facilitated. In such case, the associated individual units or mechanisms as described above will be disposed in correspondingly inclined positions.

In this connection, it should be mentioned that the divider unit 4 described above may be the apparatus disclosed in copending U.S. Pat. application Ser. No. 789,274 of Yukio Ito et al filed on Apr. 20, 1977 under the title of "Apparatus for Binding Paper Stack", which corresponds to Japanese Pat. application Nos. 47208/1976 and 47212/1976, and which has been assigned to the same assignees as the present application.

Also, the aforementioned clamping apparatus 10 may be the apparatus disclosed in copending U.S. Pat. application Ser. No. 789,280 of Yukio Ito et al., filed on Apr. 20, 1977 under the title of "Apparatus of Clamping Paper Stack for Winding the Same," which corresponds to Japanese Pat. Application No. 47211/1976, and which has been assigned to the same assigness as the present application. Accordingly, for any further information about such apparatus, reference should be made to the above described U.S. Pat. applications, if necessary.

The present invention is primarily directed to the arrangement for winding the binding tape 18 around the stack of paper sheets 14.

Figure 2:
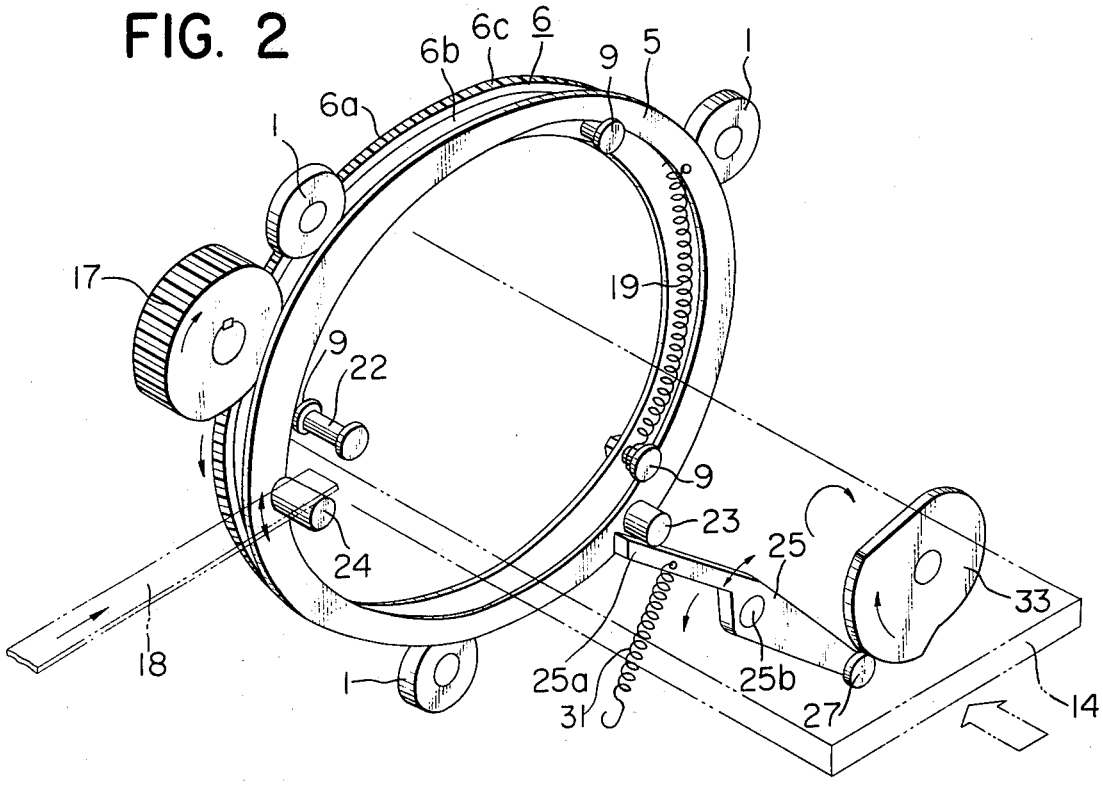
FIG. 2 is a perspective view showing the entire arrangement of the tape winding apparatus shown in FIG. 1.
Figure 3:
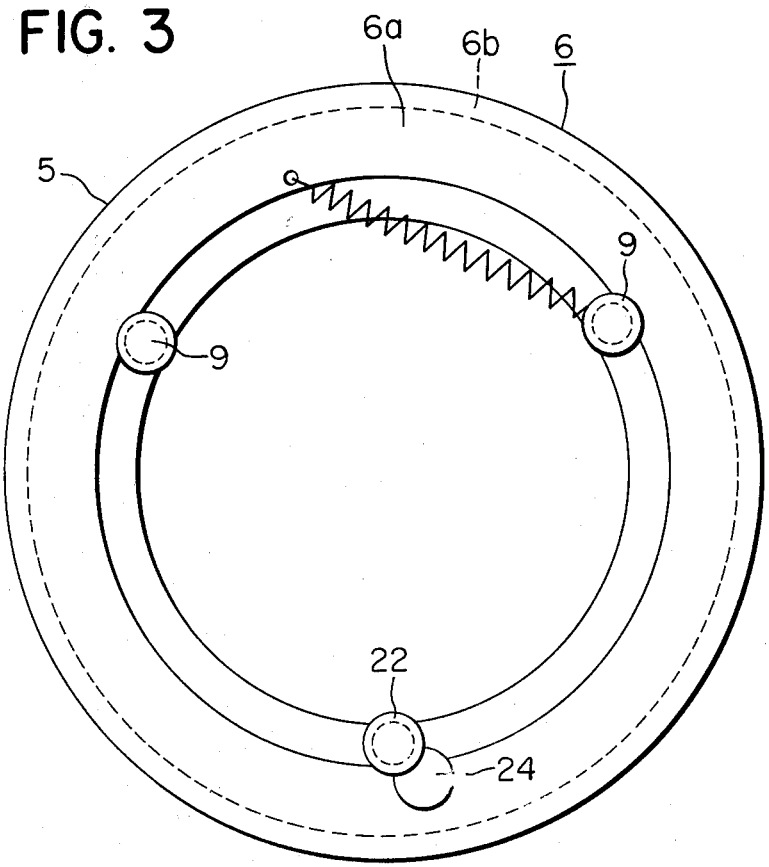
FIG. 3 is a front view showing a flyer body and a movable plate.
Figure 4:
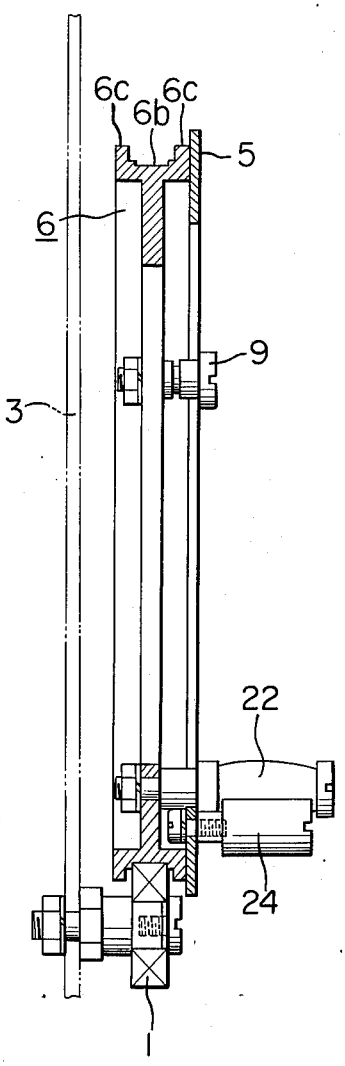
FIG. 4 is a side view showing the flyer body and the movable plate partially in section.
Figure 5:
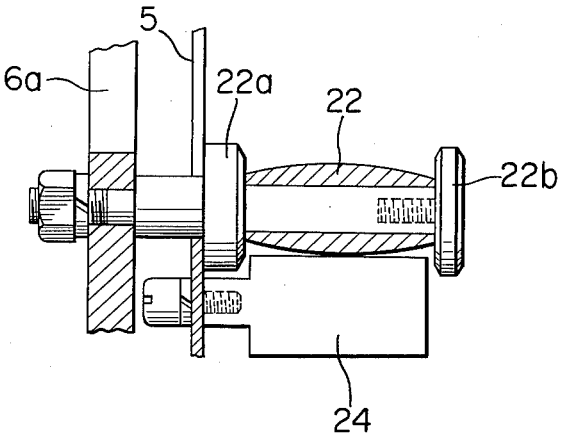
FIG. 5 is an enlarged fragmental sectional view showing guide rollers in the state in which the guide rollers are engaged with each other.

Now, referring to FIGS. 2, 3 and 4, the tape winding apparatus 6 comprises an annular flyer body 6a, which is composed of an annular ring having an outer peripheral surface formed with a peripheral groove 6*b* and gear teeth 6*c* at both sides thereof (FIG. 1). The flyer body 6*a* is rotatably supported by means of three supporting rollers 1 rotatably mounted on a supporting frame 3 (FIG. 4) at predetermined positions with equidistance therebetween and adapted to rotatably engage in the groove 6*b*. A gear 17 which is mounted at a predetermined stationary location and adapted to be driven by the driving means 12 (FIG. 1) meshes with the teeth 6*c* formed in the flyer body 6*a*. Provided in juxtaposition and coaxially with the flyer body 6*a* is a movable plate 5 which is also in the shape of an annular ring-like disk and which is supported by three pins 9 at the inner peripheral edge thereof. Pins 9 are fixedly secured to the flyer body 6*a*. Thus, the movable plate 5 can be rotated relative to the flyer body 6*a*. Numeral 22 designates a first guide roller rotatably mounted on the flyer body 6*a* at a position aligned with the pin 9. The first guide roller 22 has a convex-like circumferential surface such as shown in FIGS. 4 and 5, since such profile is very advantageous in preventing lateral displacement of the tape as it is guided by roller 22, as will be described hereinafter. A second guide roller 24 is rotatably secured to the movable plate 5 so that the roller 24 can be moved toward and away from the first guide roller 22 through the corresponding rotational movement of the plate 5. A spiral spring 19 has one end connected to one of the supporting pins 9 and the other end connected to the movable plate 5 to resiliently urge the movable plate 5 in the direction in which the second guide roller 24 can be brought into contact with the first guide roller 22. Mounted on the movable ring plate 5 is a pin 23 which is engaged by one portion 25a of a lever 25. The lever 25 is pivotally supported at substantially the midpoint thereof by a pin 25*b* and has the other end provided with a cam follower 27. A coil spring 31 is connected to the lever 25 adjacent to the end portion 25*a* and resiliently urges or biases the lever 25 in the direction shown by the arrow to move it away from the pin 23. The cam follower engages with a cam 33.

With such arrangement as described above, when a bundle of stacked paper sheets 14 are to be bound by the binding tape 18, the paper stack 14 is placed at a substantially central location of the annular flyer body 6*a* as indicated by the arrow in FIG. 2, with the annular flyer body 6*a* set at the starting position shown in FIG. 2. In this location, the paper stack 14 is positioned between a receiving base 11 and a pressing pad 13 of the clamping mechanism 10 shown in FIG. 1. In the starting position, the end portion 25*a* of the lever 25 bears against the pin 23, as a result of which the annular plate or disk 5 is moved to a position such that the second guide roller 24 is disengaged from the first guide roller 22.

Under such conditions, the binding tape or band 18 can be fed from the supply reel 16 through the pinch roller 20 and the feeding roller 21, passing through a free space between the guide rollers 22 and 24, and the leading end of the tape 18 can be thus inserted into a gap produced in the paper stack by the divider means 4 described thereinbefore. Subsequently, the cam 33 is rotated to thereby release the end portion 25*a* of the lever 25 from the pin 23, as a result of which the movable disk 5 is released from the constrained state and can be freely rotated under the force of the tension spring 19 toward the position where the second guide roller 24 bears against the first guide roller 22 with the binding tape 18 nipped therebetween. When this condition has been attained, the driving means 12 is actuated and thus the gear 17 is rotated in the direcion indicated by the arrow. This in turn results in the rotation of the annular flyer body 6a and movable ring 5 about the paper stack 14. In this manner, the binding tape 18 can be wound around the paper stack 14. When a predetermined length of the binding tape 18 has been wound, then the cutter means 26 (FIG. 1) is actuated under the control of the cam means 36 to cut the tape 18. The rotation of the flyer body 6*a* is then stopped. The binding tape is now in position for the succeeding bonding operation.

The tape dispensing operations required before the tape winding operation can be carried out automatically without requiring manual manipulaton by using an apparatus which is disclosed in a copending U.S. Pat. Application Ser. No. 789,279 of Yukio Ito et al, filed on Apr. 20, 1977 entitled "Binding Tape Dealing Apparatus, for Paper Bundle Binding Apparatus", which corresponds to Japanese Pat. application No. 47209/1976, and which has been assigned to the same assignees as the present application. During the tape winding operation described above, the binding tape is maintained in a tensioned state as nipped by the paired guide rollers. By virtue of this feature, the bundle of stacked paper sheets 14 can be positively and securely bound together by the binder tape 18.

Figure 6:
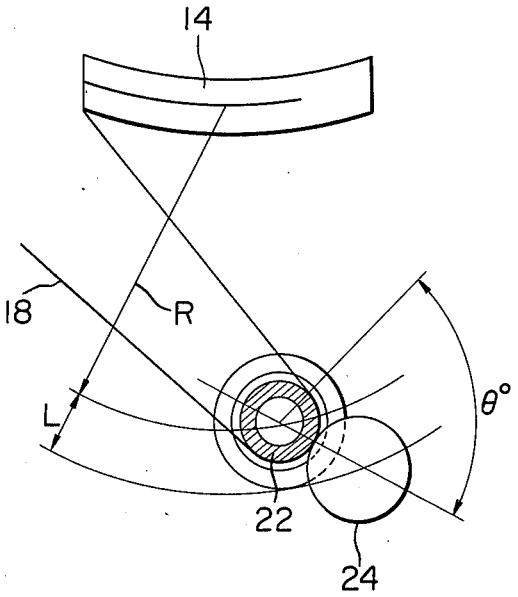
FIG. 6 schematically illustrates a manner in which a binding tape is wound around a stack of paper sheets.

Referring to FIG. 6, it is assumed that the annular flyer body 6*a* has a radius of rotation R. The paired guide rollers 22 and 24 are so positioned that the path followed by the center of roller 24 as the flyer body is rotated is spaced from the corresponding path of the roller 22 by a length L in the radial direction of the flyer body 6a. Then, the binding tape 18 is caused to contact with the surface of the guide roller 22 for an angular distance greater than an angle $\theta$ which is formed between the line passing through the centers of both guide rollers and the line which passes through the center of guide roller 22 and the circumferential point thereof at which the binding tape 18 leaves the guide roller 22. It will be appreciated that, by selecting the contact angle $\theta$ or the length L at an allowable large value, frictional engagement of the binding tape with the guide roller 22 is correspondingly increased, whereby the tension applied to the binding tape 18 as it is wound around the paper stack 14 can be maintained at a high level. In this manner, the positive and secure winding of the binder tape 18 can be assured. Additionally, this arrangement is effective to prevent any meandering movements of the binder tape 18 in combination with the convex-like profile of the guide surface of the roller 22 having collars 22*a* and 22*b* (FIG. 5).

As will be appreciated from the foregoing description, the present invention provides an apparatus which can wind a binder tape around a bundle of stacked paper sheets positively and securely with an enhanced efficiency in a completely automatic operation by maintaining the binder tape in a tensioned state during the winding operation.

Although a preferred embodiment has been shown and described above, many modifications and variations thereof will readily occur for those skilled in the art without departing from the spirit and scope of the invention defined in the appended claims.

What we claim is:

1. An apparatus for winding a binder tape around a stack of paper sheets, said apparatus comprising::

an annular flyer body having an inner hollow space in which a stack of paper sheets to be bound is adapted to be disposed;

means for rotatably supporting said annular flyer body;

means for rotating said annular flyer body about the center point thereof;

a first guide roller mounted on said flyer body at a predetermined position thereof;

an annular plate supported by said annular flyer body to be coaxial therewith, said annular plate being circumferentially movable with respect to said annular flyer body;

a second guide roller mounted on said annular plate so as to be movable with said annular plate into disengageable contact with said first guide roller for holding and guiding a binder tape in tension in coopertion with said first guide roller;

spring means for urging said second guide roller toward a position to contact said first guide roller; and means for displacing said second guide roller away from said first guide roller.

2. An apparatus as claimed in claim 1, wherein said means for displacing said second guide roller away from said first guide roller comprises lever means for controlling the movement of said annular plate, and cam means for actuating said lever means.

3. An apparatus as claimed in claim 1, wherein said first guide roller has a circumferential guide surface having a convex profile in axial cross-section.

4. An apparatus as claimed in claim 3, wherein said first guide roller is provided with collars for preventing said binder tape from meandering axially of said first guide roller.

* * * * *